US011166508B2

(12) United States Patent
Johnson

(10) Patent No.: US 11,166,508 B2
(45) Date of Patent: Nov. 9, 2021

(54) PROTECTIVE FASTENABLE HEADWRAP

(71) Applicant: Juperi Johnson, Albuquerque, NM (US)

(72) Inventor: Juperi Johnson, Albuquerque, NM (US)

( * ) Notice: Subject to any disclaimer, the term of this patent is extended or adjusted under 35 U.S.C. 154(b) by 0 days.

(21) Appl. No.: 17/065,481

(22) Filed: Oct. 7, 2020

(65) Prior Publication Data

US 2021/0106086 A1 Apr. 15, 2021

Related U.S. Application Data

(60) Provisional application No. 62/913,109, filed on Oct. 9, 2019.

(51) Int. Cl.
*A42B 1/041* (2021.01)
*A42B 1/22* (2006.01)
*A45D 8/40* (2006.01)

(52) U.S. Cl.
CPC ..... *A42B 1/041* (2013.01); *A45D 8/40* (2013.01); *A42B 1/22* (2013.01)

(58) Field of Classification Search
CPC ..... A42B 1/041; A42B 1/22; A42B 1/049; A42B 1/012; A42B 1/06; A42B 1/206; A42B 1/04; A42B 1/045; A42B 1/018; A42B 1/0186; A42B 1/019; A42B 7/00; A45D 8/40
See application file for complete search history.

(56) References Cited

U.S. PATENT DOCUMENTS 1,929,080 A * 10/1933 Schramm ..... A45D 8/40 132/274
2,263,418 A * 11/1941 Ganim ..... A42B 1/041 2/204
2,279,867 A * 4/1942 Falk ..... A42B 1/041 132/274
2,993,211 A 9/1958 Sullivan
5,621,919 A 4/1997 Graham
6,481,020 B1 11/2002 Kirkland
6,560,784 B2 5/2003 Hill
7,634,819 B2 12/2009 Grey
9,084,446 B2 7/2015 Ramadan
9,138,025 B1 * 9/2015 Lunsford ..... A42B 1/04
9,907,381 B2 3/2018 Tussey
(Continued)

FOREIGN PATENT DOCUMENTS

FR 717985 A * 1/1932 ..... A42B 1/041
GB 137465 A * 1/1920 ..... A42B 1/041
GB 345857 A * 4/1931 ..... A42B 1/041

*Primary Examiner* — Amy Vanatta
(74) *Attorney, Agent, or Firm* — Michael C. Balaguy

(57) ABSTRACT

A headwrap provides fastening mechanisms for covering, protecting, and retaining the hair of a wearer. A fabric panel forming the headwrap may be defined by a head covering, a crown circumscribing the head covering, and a tail extending rearwardly from the crown and having an internal volume able to contain and cover the hair of the wearer. Left and right straps affixed to a base of the tail enable a wearer to tension the straps about the crown to tighten the head covering over the head, tying the straps off at the front of the crown. A loop affixed to a terminus of the tail enables a user to draw the tail forward and hang the loop off a button affixed about the crown on the forehead.

2 Claims, 5 Drawing Sheets

(56) References Cited

U.S. PATENT DOCUMENTS

| | | | | |
|---|---|---|---|---|
| 2005/0034215 | A1* | 2/2005 | Harrison | A42B 3/10 2/207 |
| 2016/0198830 | A1* | 7/2016 | Tussey | A45D 8/40 2/183 |
| 2017/0027262 | A1* | 2/2017 | Palmer | A42B 1/12 |
| 2017/0042268 | A1* | 2/2017 | Lessard | A47K 10/02 |
| 2017/0311692 | A1 | 11/2017 | Morgan | |
| 2018/0249804 | A1* | 9/2018 | Walker | A42B 1/041 |
| 2019/0037944 | A1* | 2/2019 | Tussey | A42B 1/18 |
| 2019/0110542 | A1* | 4/2019 | Kolonne | A42B 1/12 |
| 2020/0390178 | A1* | 12/2020 | Karr Johnson | A42B 1/041 |

* cited by examiner

PROTECTIVE FASTENABLE HEADWRAP

CROSS-REFERENCE TO RELATED APPLICATION(S)

The present application is related to and claims priority to U.S. Provisional Patent Application No. 62/913,109 filed Oct. 9, 2019, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of apparel of existing art and more specifically relates to headwraps.

RELATED ART

Many individuals expend significant effort in cultivating and maintaining their hair. However, good hair maintenance can be foiled at night when individuals toss and turn in bed. Hair may become frizzled, tangled, and pulled out of alignment with a particular hairstyle. Hair features such as extensions may become mangled or otherwise damaged. Accordingly, there is perceived a need for a solution which protects hair during sleep.

U.S. Pat. No. 6,560,784 to Jordan Heather Meredith Hill relates to a multi-layered moisture resistant hair wrap. The described multi-layered moisture resistant hair wrap includes a multi-layered moisture resistant hair wrap surrounds a person's entire head of hair protecting, maintaining, and prolonging a hairstyle and adapted to do so in moist environments that include water, steam, mist and humidity and absorbing moisture generated from heat or perspiration from one's scalp.

SUMMARY OF THE INVENTION

In view of the foregoing disadvantages inherent in the known headwrap art, the present disclosure provides a novel protective fastenable headwrap. The general purpose of the present disclosure, which will be described subsequently in greater detail, is to provide a protective fastenable headwrap.

A headwrap provides fastening mechanisms for covering, protecting, and retaining the hair of a wearer. A fabric panel forming the headwrap may be defined by a head covering, a crown circumscribing the head covering, and a tail extending rearwardly from the crown and having an internal volume able to contain and cover the hair of the wearer. Left and right straps affixed to a base of the tail enable a wearer to tension the straps about the crown to tighten the head covering over the head, tying the straps off at the front of the crown. A loop affixed to a terminus of the tail enables a user to draw the tail forward and hang the loop off a button affixed about the crown on the forehead.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a protective fastenable headwrap, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a headwrap and more particularly to a protective fastenable headwrap as used to improve the protection of hair during sleep and other situations.

Generally, the protective fastenable headwrap is a head covering useful for protecting and preserving hair, especially while the wearer is sleeping. The wrap is sufficiently adjustable through means of straps and a button fastener to fit a wide range of volume of hair. The headwrap provides a barrier between the hair rubbing against other objects, preventing the hair from becoming messy, tangled, and frizzled while the wearer tosses and turns in bed at night. Satin or silk may be used to construct the wrap for maximum comfort. Protecting brittle ends and edges also serves to encourage healthy hair growth over time. In addition to the protective function, the headwrap may also serve as a fashion accessory. In some embodiments, logos or designs may be incorporated into the headwrap.

The headwrap includes a head covering that extends into a V-shaped tail. This tail may be creased to define an internal volume which can be used to cover and contain long hair. The tail may terminate in a loop which can be attached to a button on the forehead of the head covering. In this way, hair contained within the tail may be constrained against the neck and head of the wearer when the tail is attached to the button at the front of the head covering.

Furthermore, the headwrap includes two straps, one on the left of the headwrap, and one on the right. In use, these may be further used to affix and constrain the headwrap. A user may cross the straps over each other at the back of the neck and then wrap each strap around the opposite side of the headwrap to the front, where the meeting straps may be tied together. In some embodiments, sleeves may be provided on the left and right side of the headwrap which the straps may be passed through for further retention and to streamline the headwrap when tied taut.

Referring now more specifically to the drawings by numerals of reference, there is shown in FIGS. 1-5C, various views of a headwrap 100.

Figure 1:
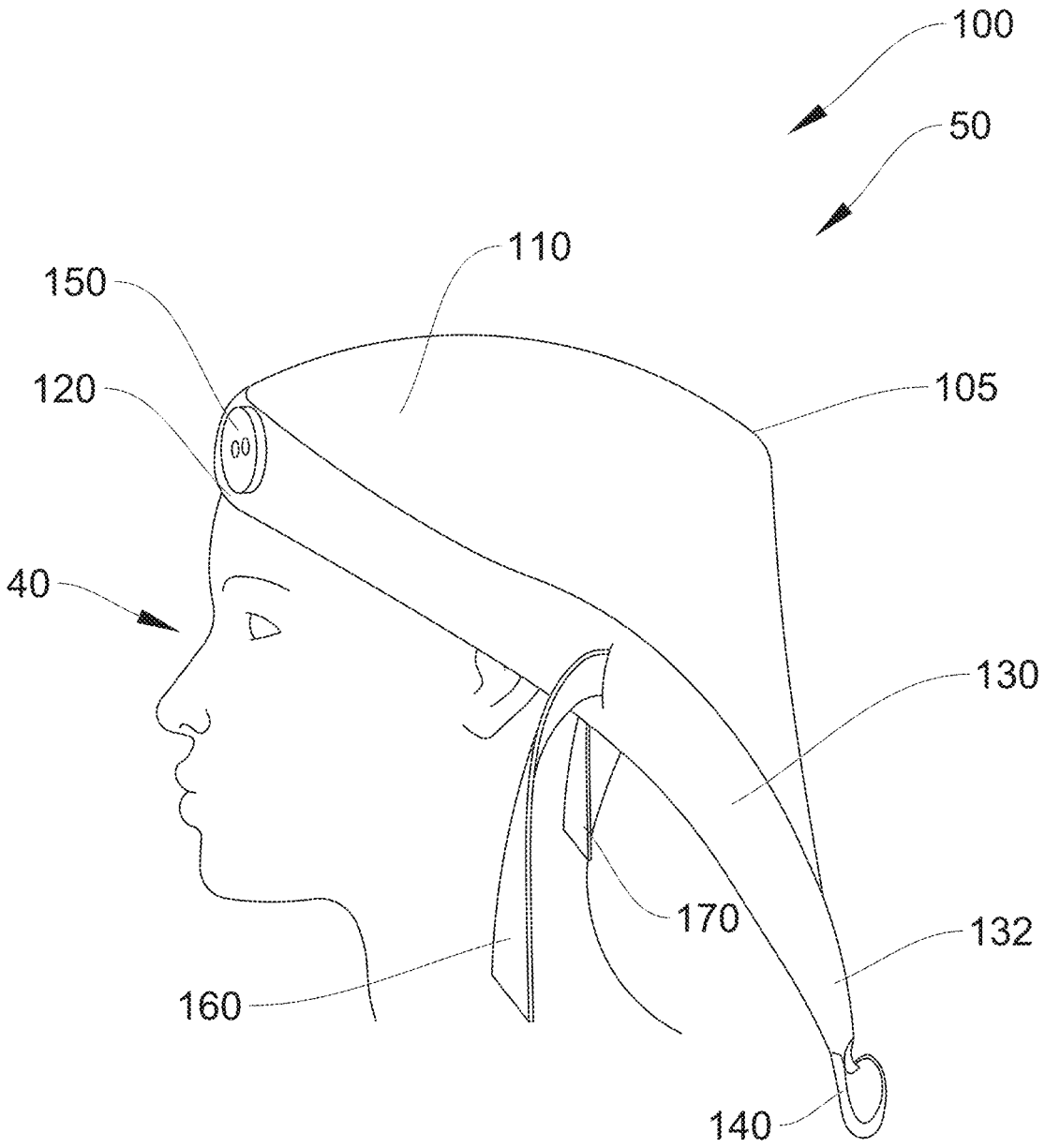
FIG. 1 is a side perspective view of the protective fastenable headwrap during a 'relaxed' condition, according to an embodiment of the present disclosure.

FIG. 1 is a side perspective view of the protective fastenable headwrap during a 'relaxed' condition 50, according to an embodiment of the present disclosure. Here, the headwrap may be beneficial for use by a user 40 to protect the hair during sleep and other settings. As illustrated, headwrap 100 may include fabric panel 105. Fabric panel 105 is preferably a unitary piece of fabric, but in some embodiments may comprise multiple fabric components stitched together. Fabric panel 105 may include head covering 110, crown 120, and tapered tail 130. Head covering 110 may be substantially circular when laid flat and may be domed-shaped when relaxed so as to naturally conform to the shape of a human head. Crown 120 may define a lower perimeter of head covering 110, forming a rim or base of the dome shape which be circumscribe the head covering and pass fully around the head of user 40 when worn. Crown 120 may be constructed of layered fabric. In one embodiment, a lower edge of fabric panel 105 may be folded up and stitched to form a double layered row of fabric defining crown 120. Such a stitched double layer may be advantageous for strength, durability, and tensioning head covering 110 into the domed shape necessary for conforming to the shape of the head of user 40. In a frontal area of the head of user 40 crown 120 may be passed above the brow. At the rear area of the head of user 40 crown 120 may be passed as low as the neckline. Tapered tail 130 extends off of one end of crown 120. In use, tapered tail should be positioned rearwardly from the head of user (off the back of the head opposite the face). Tapered tail 130 may be centrally creased in some embodiments, and may be shaped such that the crease forms a peak of a convexity. The convexity of tapered tail 130 may be advantageous in order to make tapered tail 130 volumous and better able to contain, cover, and protect the hair of user 40. The crease runs from the head covering 110 directly to terminus 132, effectively bisecting tapered tail 130. A flexible loop 140 may be affixed, sewn, or otherwise attached to terminus 132 of tapered tail 130. A button 150 may be affixed, sewn, or otherwise attached to crown 120. Left-strap 160 and right-strap 170 may each consist of flat straps of fabric, each affixed at one end to tapered tail 130, and affixed to left and right sides of tapered tail 130 respectively. Fabric panel 105 may be elastic in some embodiments. In yet further embodiments, fabric panel 105 may be constructed of a "set and soak" material.

Figure 2:
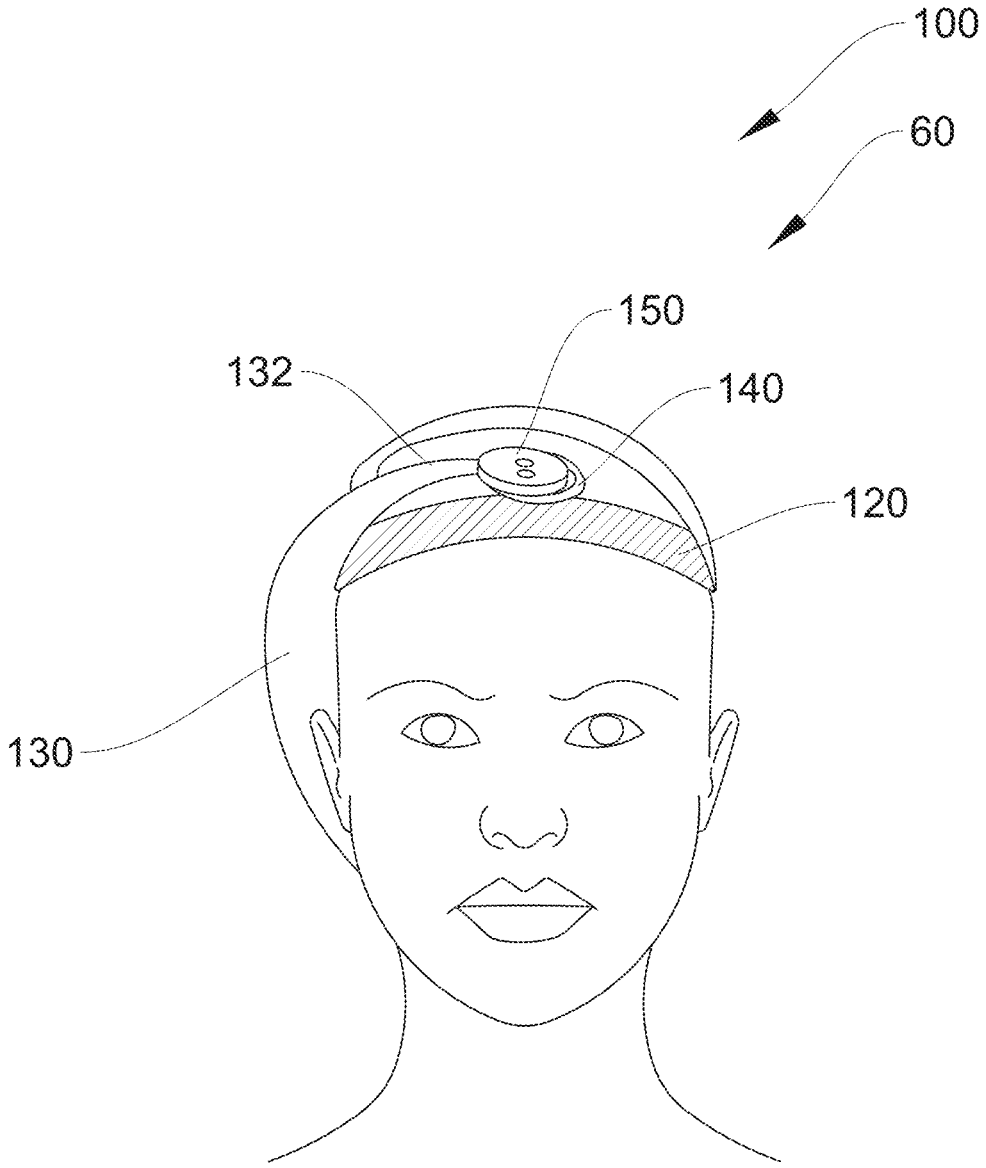
FIG. 2 is a front perspective view of the protective fastenable headwrap of FIG. 1, according to an embodiment of the present disclosure, in a 'wrapped' condition.

FIG. 2 is a front perspective view of the protective fastenable headwrap of FIG. 1, according to an embodiment of the present disclosure, in a 'wrapped' condition 60. In use, when worn, tapered tail 130 may be wrapped (containing hair of the user) alongside the head of user 40 (FIG. 1), terminus 132 drawn against crown 120, and loop 140 hung from button 150. In this way, the hair of user 40 (FIG. 1) (contained within and covered by tapered tail 130) may be conveniently held alongside the head.

Figure 3:
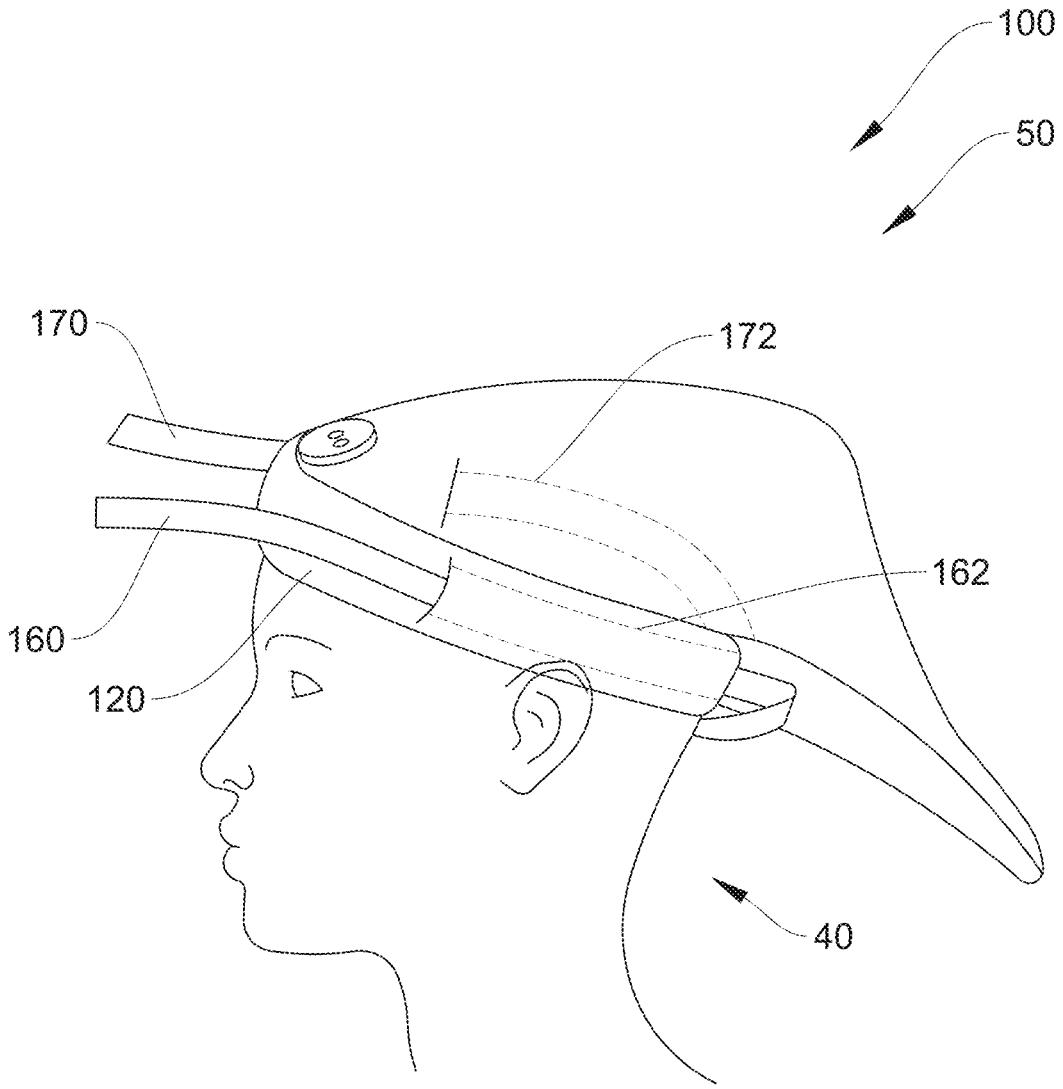
FIG. 3 is a side perspective view of the protective fastenable headwrap of FIG. 1 during a 'relaxed' condition, according to an embodiment of the present disclosure.

FIG. 3 is a side perspective view of the protective fastenable headwrap of FIG. 1 during a 'relaxed' condition 50, according to an embodiment of the present disclosure. As before, left-strap 160 and right-strap 170 may each consist of flat straps of fabric, each affixed at one end to tapered tail 130 (FIG. 1), and affixed to left and right sides of tapered tail 130 (FIG. 1) respectively. Preferably, each of left-strap 160 and right-strap 170 are stitched to tapered tail 130 (FIG. 1). In some embodiments, crown 120 may further include left-sleeve 162 and right-sleeve 172, which left-strap 160 and right-strap 170 may be passed through respectively. Left-sleeve 162 and right-sleeve 172 are optional components which may be used to streamline headwrap 100 and partially conceal left-strap 160 and right-strap 170 while in use. Left-strap 160 and right-side 170 may be long enough to pass over a brow of user 40 at crown 120 (FIG. 1).

Figure 4:
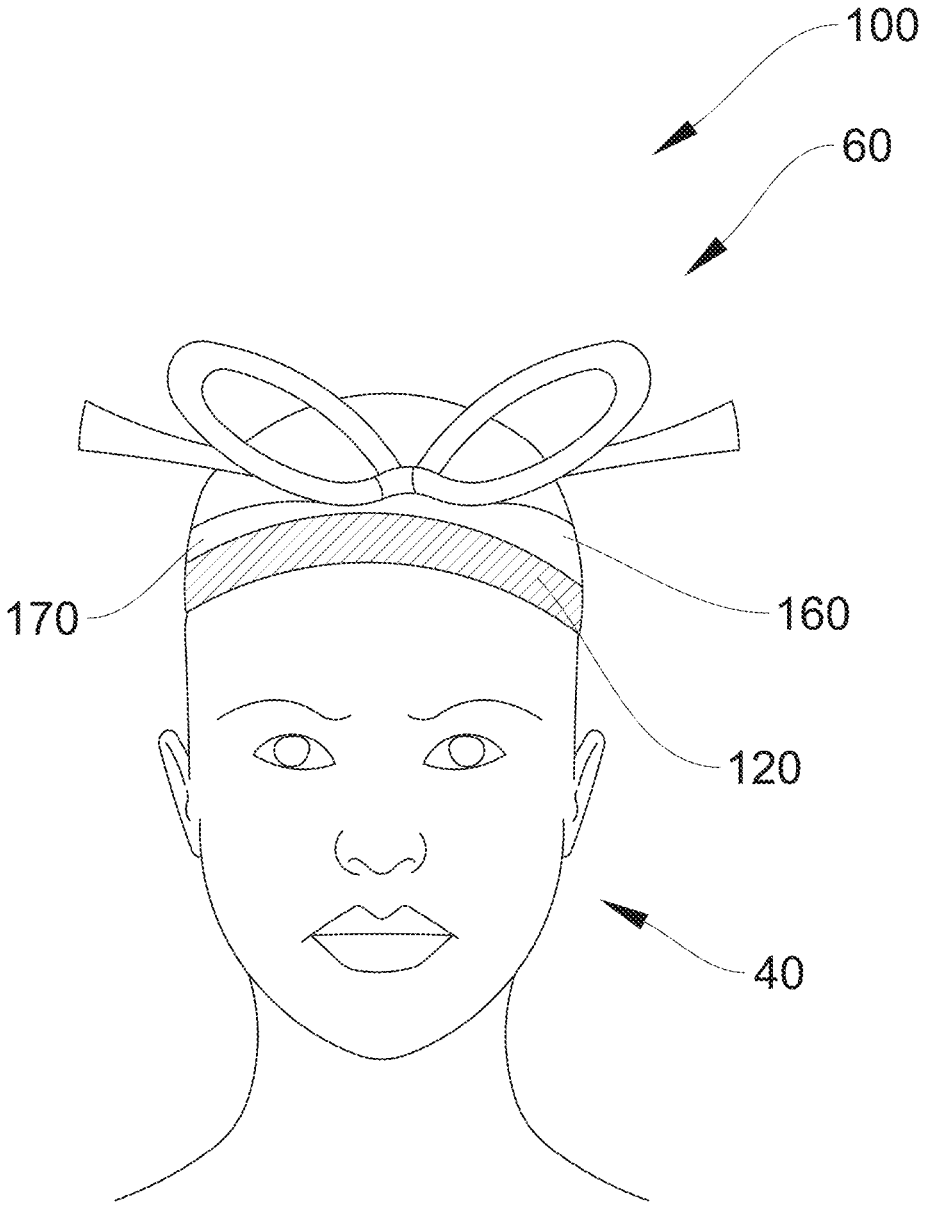
FIG. 4 is a front perspective view of the protective fastenable headwrap of FIG. 1, according to an embodiment of the present disclosure, in a 'wrapped' condition.

FIG. 4 is a front perspective view of the protective fastenable headwrap of FIG. 1, according to an embodiment of the present disclosure, in a 'wrapped' condition 60. As illustrated, left-strap 160 and right-strap 170 may each be passed over a brow of user 40 at crown 120 and tied together at crown 120 to fasten head covering 110 (FIG. 1) securely about the head of user 40. Preferably, left-strap 160 and right-strap 170 are tied over crown 120 in the illustrated manner before tapered tail 130 (FIG. 2) is wrapped about the head of user 40 and loop 140 (FIG. 2) is hung from button 150 (FIG. 2).

Figures 5A, 5B, 5C:
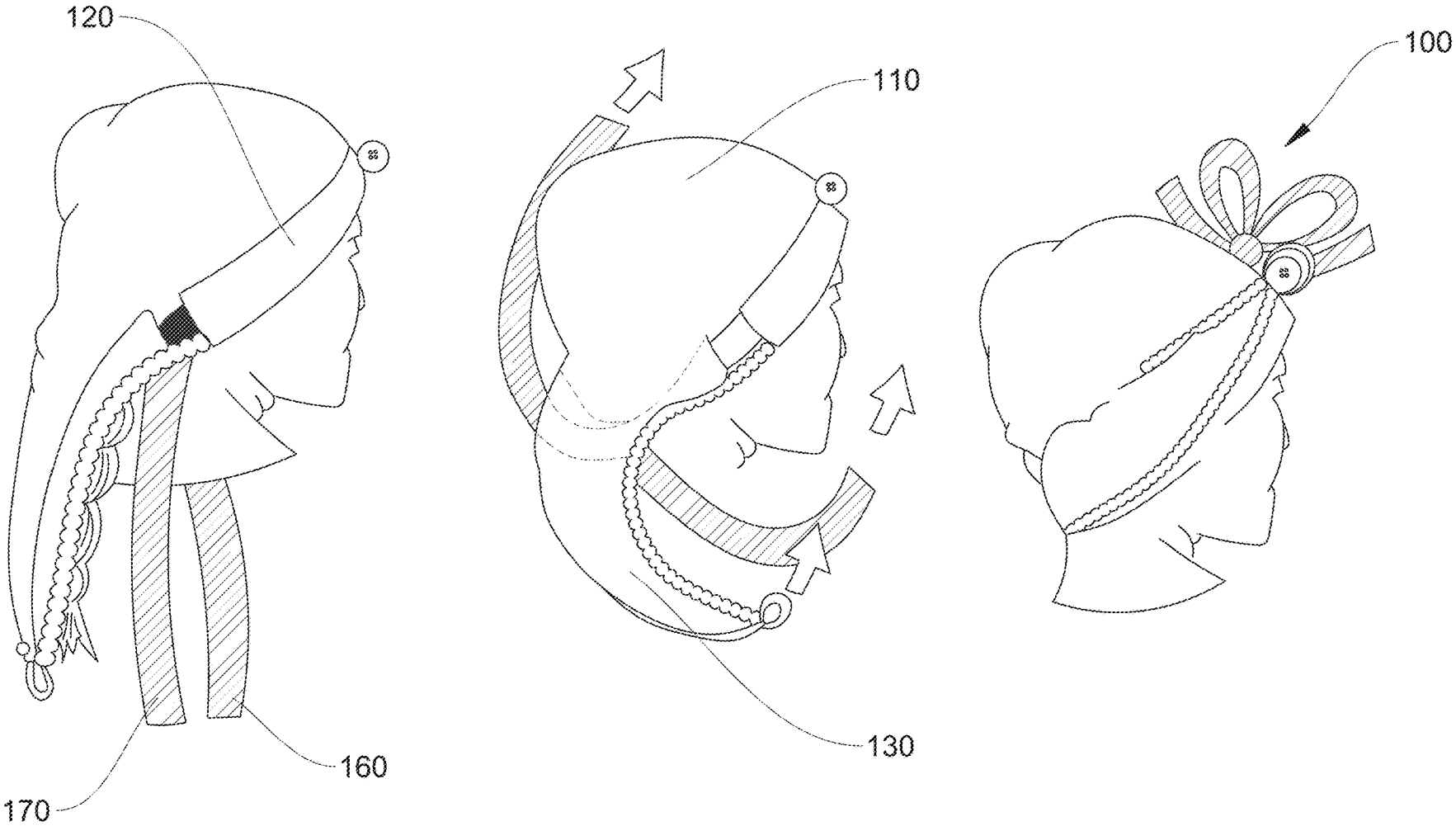
FIGS. 5A-5C are perspective views illustrating the process of securing the protective fastenable headwrap to the head of a wearer.

FIGS. 5A-5C are perspective views illustrating the process of securing headwrap 100. In FIG. 5A, left-strap 160 and right-strap 170 are tensioned about crown 120 passed through left-sleeve 162 and right-sleeve 172 respectively and tied off. Preferably, left-strap 160 and right-strap 170 are criss-crossed behind the neck before pulling them forward; in such an event, they may pass through the opposing sleeve. Some users may prefer not to use left-sleeve 162 and right-sleeve 172 at all, and left-sleeve 162 and right-sleeve 172 may even be omitted in some embodiments. In FIG. 5B, head covering 110 is now tensioned, and tapered tail 130 is pulled forward, and terminus 132 drawn to crown 120. In FIG. 5C, loop 140 (FIG. 2) is hung from button 150 (FIG. 2), and tapered tail 130 is now securely wrapped and held against the head of the user.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A headwrap comprising:

a fabric panel having a head covering, a crown circumscribing the head covering, and a tapered tail extending from the crown, the tapered tail defining an interior volume able to cover and contain hair;

a loop affixed to a terminus of the tapered tail;

a button affixed to the fabric panel opposite the tapered tail;

a left-strap affixed to the tapered tail; and a right-strap affixed to the tapered tail;

a left-sleeve; and a right-sleeve;

wherein each of the left-strap and the right-strap are sufficiently long to reach from the tapered tail to the button;

wherein the left-strap may be passed through the left-sleeve and the right-strap may be passed through the right-sleeve;

wherein the tapered tail is bisected by a crease;

wherein the crown is defined by a periphery fold of the fabric panel which is laid flat against the head covering and stitched to the head covering;

wherein the fabric panel is constructed of satin; and wherein the button is affixed to the crown.

2. A headwrap comprising:

a fabric panel having a head covering, a crown circumscribing the head covering, and a tapered tail extending from the crown, the tapered tail defining an interior volume able to cover and contain hair;

a loop affixed to a terminus of the tapered tail;

a button affixed to the fabric panel opposite the tapered tail;

a left-strap affixed to the tapered tail; and a right-strap affixed to the tapered tail;

a left-sleeve; and a right-sleeve;

wherein each of the left-strap and the right-strap are sufficiently long to reach from the tapered tail to the button;

wherein the left-strap may be passed through the left-sleeve and the right-strap may be passed through the right-sleeve;

wherein the tapered tail is bisected by a crease;

wherein the crown is defined by a periphery fold of the fabric panel which is laid flat against the head covering and stitched to the head covering; and wherein the button is affixed to the crown.

* * * * *